United States Patent [19]

Tielrooy

[11] 3,962,970

[45] June 15, 1976

[54] APPARATUS FOR SUPPORTING AND PRINTING NON-CIRCULAR CONTAINERS

[75] Inventor: Robert Willem Tielrooy, Amstelveen, Netherlands

[73] Assignee: Van Dam Machine Corporation, Amsterdam, Netherlands

[22] Filed: Dec. 2, 1974

[21] Appl. No.: 528,909

[30] Foreign Application Priority Data

Dec. 6, 1973 Netherlands ..... 7316702

[52] U.S. Cl. ..... 101/38 A; 269/47; 269/51

[51] Int. Cl.[2] ..... B41F 17/26

[58] Field of Search ..... 101/38 R, 38 A, 39, 101/40, 126; 269/48, 48.1, 47, 49, 50, 51, 52; 279/2 R; 51/103 WH; 156/457

[56] References Cited

UNITED STATES PATENTS

| | | | |
|---|---|---|---|
| 1,946,483 | 2/1934 | Casto et al. | 101/38 R X |
| 2,796,164 | 6/1957 | Hakogi | 101/40 X |
| 2,856,058 | 10/1958 | Todd et al. | 101/38 R X |
| 2,881,699 | 4/1959 | Hakogi | 101/39 X |
| 3,019,725 | 2/1962 | Freeman | 101/38 R |
| 3,162,115 | 12/1964 | Bauer | 101/39 |
| 3,411,439 | 11/1968 | Moes et al. | 101/38 R |
| 3,587,816 | 6/1971 | Russell et al. | 101/38 A UX |

FOREIGN PATENTS OR APPLICATIONS

| | | | |
|---|---|---|---|
| 14,509 | 6/1956 | Germany | 101/39 |
| 319,192 | 1/1970 | Sweden | 101/39 |

*Primary Examiner*—Clifford D. Crowder
*Attorney, Agent, or Firm*—W. G. Fasse; W. W. Roberts

[57] ABSTRACT

A method and device for printing upon a container wall, wherein during printing the container inner wall is moved around a circular rotatable support which keeps the container wall pressed directly against a rotating printing surface at the stop on which it is being printed. The cross sectional area of said support is a certain fraction of the cross sectional area of the container and the longitudinal position of the container wall is registered for the printing with the aid of a second spaced circular and withdrawable inner positioning support.

4 Claims, 7 Drawing Figures

APPARATUS FOR SUPPORTING AND PRINTING NON-CIRCULAR CONTAINERS

BACKGROUND OF THE INVENTION

The present invention relates to an apparatus for printing upon the wall of a container, whereby during printing the wall of the container is moved around a rotatable support which keeps the container wall pressed directly against a rotating printing surface.

For printing upon or painting containers it has hitherto been the practice to use an internal support whose circumference abuts precisely upon the inner wall of the container whereby it is possible with the aid of this rotatable support to carry out continuous printing either only upon circular beakers or only upon substantially rectangular containers of a specified size and shape.

SUMMARY OF THE INVENTION

The object of the invention is to avoid this drawback, which is achieved in that the inner circumferences of the moving or rotating container wall rest upon a support of circular cross-section only at the spot at which it is being printed upon. Since the circular support situated inside the container does not completely fill the container but only has a small contact surface in common with it, the container wall can easily be moved around the support for printing, so that it is not only possible to print upon circular and rectangular containers all around in one single operation. Hence, it is also possible to print upon possible corners and in colours with only one printing installation and one set of inking apparatus. Another advantage resides in proportionally shortening the adjusting time and obtaining better control over the inking apparatus. In addition the container wall may consist of curved and corrugated surfaces which extend perpendicularly or are inclined to the bottom surface. Furthermore, it is possible by the method according to the invention to print upon circular containers which taper, for instance, towards their top, an operation which was not possible with prior-art container supports that completely filled the container space. Then again, with the method according to the invention the same internal support may be used for containers having different diameters.

In principle, the movement of the container can be performed in any desired manner, for instance with a driven support or with the aid of a separate member that acts upon the wall of the container. The invention, however, also renders it possible for the wall of the container to be carried along around the support solely by the friction of the rotating printing surface, A device for carrying out the method according to the invention is equipped in the manner of the prior art with an internal and rotatable by stationary support with a circular cross-section that keeps the moving container wall pressed against a rotating printing area and is characterized in that the cross-sectional area of the rotatable support touching the container wall at its point of tangency to the rotating printing surface, is a certain fraction of the cross-sectional area of the container.

The positioning, or registering of the container for ensuring faultless printing upon it, may be accomplished in several ways. According to the invention, the positioning is accomplished by securing the rotatable support in an upright position to a load-bearing element which is provided with a second erect support situated at a distance from the rotatable support. The two supports act internally upon the container wall and bring the latter parallel to the rotating printing surface to position the container wall longitudinally with respect to the rotating printing surface. The position of the top edge of the container with respect to the load-bearing element is then fixed by an external stop. In this way uneven or incorrectly stamped impressions are completely avoided. In a simple and well-working embodiment each of the two supports can furthermore be made to fit into respective diagonally opposite corner of the container. Such support includes a stationary, but rotating arbor and a removable positioning arbor. The height stop is a plate which presses the bottom of the container in the direction of the load-bearing element also in the form of a plate.

For a continuous printing process a plurality of load-bearing elements may be fitted to an intermittently movable wheel circumference, and the accessory height stops and the positioning arbors may be provided with a cam drive. According to the invention the stacked containers that are to be printed upon can in that case drop one at a time onto a support situated on the upper side of the wheel, and, having been registered longitudinally in position by the rotatable mandrel or arbor the container may be held in position by suction; after a turn of the wheel they are fixed in the height direction by the height stop and, after removal of the positioning mandrel, they can be printed upon and be carried away by dropping onto a vacuum belt located below the wheel. In this way a quick-working, relatively cheap and perfectly reliable printing device is provided.

BRIEF FIGURE DESCRIPTION

The invention will be further described below with reference to the drawings, in which an embodiment of the printing device according to the invention is shown by way of example. In these drawings:

FIG. 1: is an elevational side view of the device. FIG. 1*a*: shows a top plan view of a container positioned with its bottom upwards on a carrying support and with positioning arbors placed inside the container as viewed in the direction A-B in FIG. 1;

FIG. 2: is a view of the printing station of the device according to FIG. 1;

FIG. 3: is the accessory offset machine with an adjacent carrying support and a container; and FIGS. 3*a*, 3*b*and 3*c*: show different stages in the course of printing upon the container wall.

DETAILED DESCRIPTION OF EXAMPLE EMBODIMENTS

Figure 1:
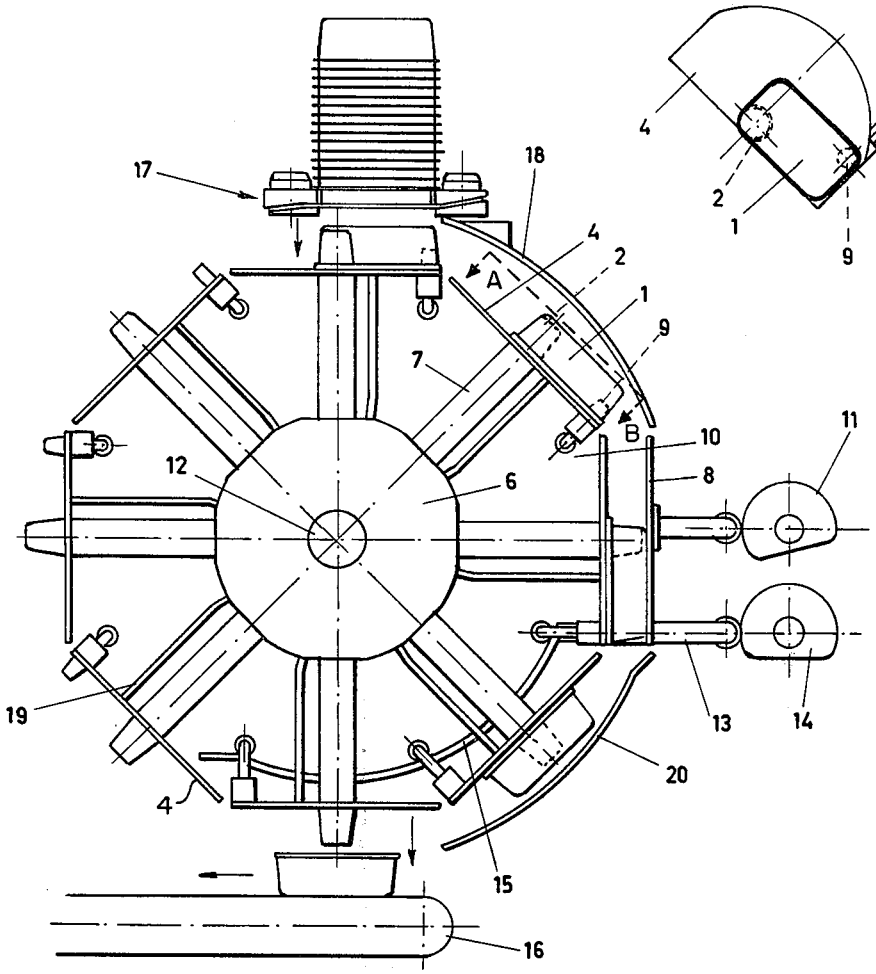
Figure 1A:
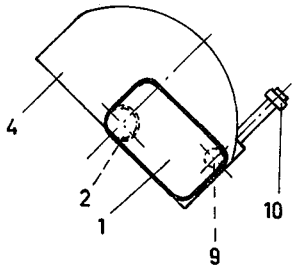
Figure 2:
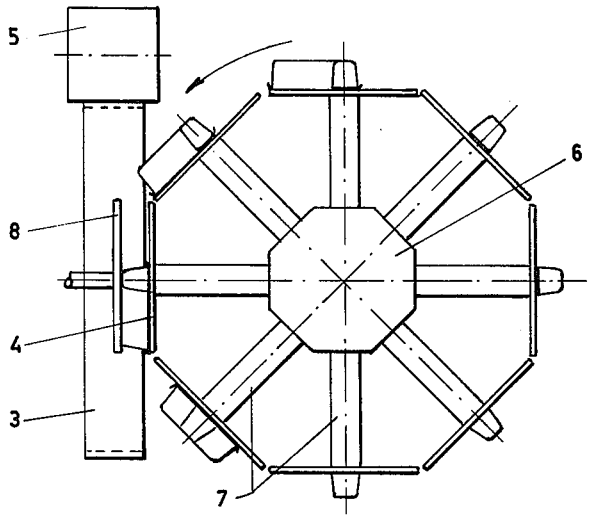

The device shown in FIG. 1 comprises a plurality of carrying supports 4, fitted in rows to the circumference of a wheel 7 carrying an indexing disk 6 which drives the device. By means of worms 17, a substantially rectangular plastic container 1 is detached at regular time intervals, in accordance with the indexing disk 6, from a stack of containers at the upper side of the wheel, which container arrives on the plate-shaped carrying support 4 below it. For this purpose each carrying support 4 has a printing mandrel or arbor 2 extending to the bottom of the container. The mandrel 2 is rotatable about its axis and fits into a corner of the container. In addition the carrying support 4 has at the diagonally opposite corner of the container a shorter positioning mandrel or arbor 9 which fits into this opposite corner. The container is internally tensioned on these mandrels, which therefore ensure that the container wall is fixed to the carrying support in a certain longitudinal position which is the same for every container. Through a hose-pipe 19 a vacuum is, moreover, created in order to keep the container 1 on the carrying support 4.

Figure 3:
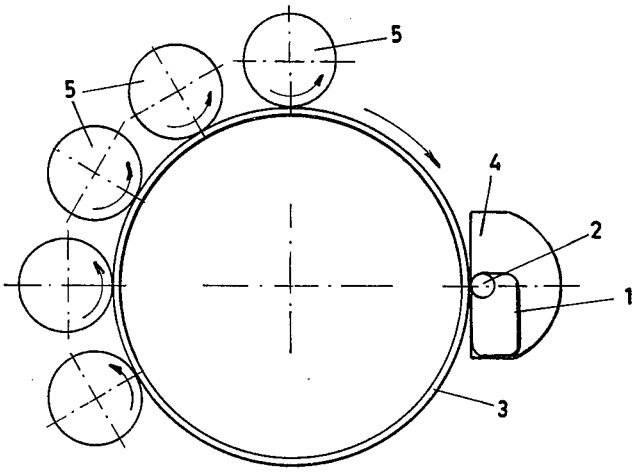
Figure 3A:
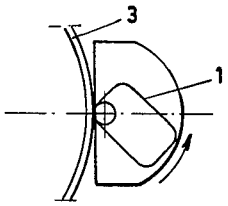
Figure 3B:
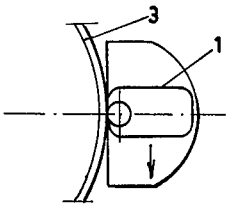
Figure 3C:
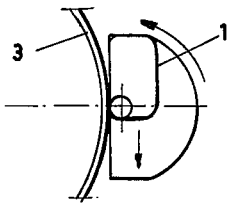

By means of the indexing disk 6 the carrying support 4 together with the container 1 is then moved stepwise under a cover plate 18 into the three-o'clock position at which printing is effected. For this purpose the vacuum is lifted and the container wall fixed and supported in its height direction with the aid of a hold-down plate or stop 8 operated by means of a cam 11, which is coupled with the indexing disk 6, and the positioning mandrel 9. The mandrel 9 is in contact through a cam pusher rod 13 with a cam 14 driven by the indexing disk 6, whereby the mandrel 9 may be withdrawn inwardly from the container space through the carrying support 4. In he course of this radially inward movement the cam follower 10 at the other end of the cam pusher rod 13 engages a fixed cam track 15 against to the action of a spring. For printing, use is made of an offset press rubber cloth cyliner 3, which carries the printing images received from the cliche rollers 5 and whose printing surface rotates along the rotatable mandrel 2 and carries the container wall with it by friction in the manner illustrated in FIGS. 3-3c thereby printing over the entire circumference. By these features the position of the container wall is precisely determined with respect to the rotatable mandrel and the rotating printing surface of the rubber cloth cylinder, any any errors in positioning or registering have been eliminated.

After the printing operation, the carrying support 4 together with the printed container is rotated, while being held by vacuum applied through the suction pipe 19, under a housing wall 20 to the lower side of wheel 7, where the container is carried away by a vacuum conveyor belt 16. The positioning mandrel 9 is withdrawn from the container by the fixed cam track 15. This cam track ends a short way past the belt 16, so that the positioning mandrel 9 can then return to its original position.

I claim:

1. In an apparatus for printing on the outer surface of a container having a given cross sectional area by rotating or moving the container surface around rotatable mandrel means which reach into the container for pressing the container surface against a rotating printing surface, the improvement wherein said mandrel means comprise a first mandrel, means rotatably supporting said first mandrel, said first mandrel having a circular cross section smaller in area than said given cross sectional area of said container, said first mandrel being positioned relative to said rotating printing surface to perform said pressing of the outer container wall against the printing surface, a second mandrel located in parallel to and spaced from said first mandrel for cooperation with said first mandrel inside a container to position said container prior to printing, and actuating means operatively connected to said second mandrel for withdrawing said second mandrel from said container prior and during printing.

2. The apparatus according to claim 1, further comprising first plate means for locating a container thereon, said means supporting said first mandrel being secured to said first plate means, a hole in said first plate means, said second mandrel extending movably through said hole at a location substantially diagonally opposite said first mandrel relative to a container for locating said container prior to printing, movable second plate means arranged in parallel to said first plate means, and drive means operatively connected to said second plate means for holding the second plate means just sufficiently against said container so that the latter is rotatable between the first and second plate means.

3. The apparatus according to claim 2, further comprising intermittently rotatable wheel means, means securing said first plate means to said wheel means, said actuating means for said second mandrel and said drive means for said second plate means comprising cam and cam follower means responsive to the rotation of said wheel.

4. The apparatus according to claim 2, further comprising container supply means arranged at a first position relative to said wheel means for depositing from a container stack one container onto each first plate means as the wheel means rotate past the container supply means, said second plate means being arranged at a second position in the direction of rotation of said wheel following said container supply means, container removal means located at a third position in the direction of rotation of said wheel means following said second plate means, and vacuum means operatively holding a container to said first plate means at least when the wheel transports a container from position to position.

* * * * *